US007575640B2

(12) United States Patent
Pollach

(10) Patent No.: US 7,575,640 B2
(45) Date of Patent: Aug. 18, 2009

(54) METHOD FOR PRODUCING SUGAR AND SUGAR-CONTAINING PRODUCTS FROM SUGAR-CONTAINING PLANT RAW MATERIALS

(75) Inventor: Günter Pollach, Gross-Enzersdorf (AT)

(73) Assignee: Zuckerforschung Tulln Gesellschaft m.b.H., Vienna (AT)

( * ) Notice: Subject to any disclaimer, the term of this patent is extended or adjusted under 35 U.S.C. 154(b) by 149 days.

(21) Appl. No.: 10/548,724

(22) PCT Filed: Mar. 4, 2004

(86) PCT No.: PCT/AT2004/000068

§ 371 (c)(1),
(2), (4) Date: Oct. 3, 2005

(87) PCT Pub. No.: WO2004/081236

PCT Pub. Date: Sep. 23, 2004

(65) Prior Publication Data

US 2006/0157051 A1 Jul. 20, 2006

(30) Foreign Application Priority Data

Mar. 11, 2003 (AT) ..... A 378/2003

(51) Int. Cl.

| | |
|---|---|
| ***C13F 3/00*** | (2006.01) |
| ***C13D 1/00*** | (2006.01) |
| ***C13D 1/02*** | (2006.01) |
| ***C13D 1/08*** | (2006.01) |
| ***C13D 3/00*** | (2006.01) |

(52) U.S. Cl. ..... 127/44; 127/29; 127/30; 127/46.1; 127/63

(58) Field of Classification Search ..... 127/29, 127/30, 44, 46.1, 63
See application file for complete search history.

(56) References Cited

U.S. PATENT DOCUMENTS

| | | | | |
|---|---|---|---|---|
| 3,108,907 | A | 10/1963 | Cucullu | |
| 4,427,454 | A * | 1/1984 | Oyama et al. | 127/44 |
| 5,434,182 | A | 7/1995 | Isaacs et al. | |
| 6,200,619 | B1 | 3/2001 | Nakamura et al. | |
| 6,770,147 | B2 * | 8/2004 | Pollach et al. | 127/42 |
| 6,893,857 | B1 * | 5/2005 | Maye et al. | 435/243 |
| 2003/0101990 | A1 | 6/2003 | Pollach et al. | |
| 2004/0265443 | A1 | 12/2004 | Beltran et al. | |
| 2006/0013842 | A1 * | 1/2006 | Matkin et al. | 424/401 |

FOREIGN PATENT DOCUMENTS

| | | | |
|---|---|---|---|
| DE | 132 132 | | 8/1978 |
| DE | 101 36 260 | A1 | 2/2003 |
| EP | 0681 029 | A2 | 4/1995 |
| GB | 466158 | | 7/1935 |
| JP | 5963199 | | 10/1984 |
| JP | 62163678 | A | 7/1987 |
| WO | 01/88205 | A1 | 11/2001 |
| WO | 03/034842 | A1 | 5/2003 |

* cited by examiner

*Primary Examiner*—David M Brunsman
(74) *Attorney, Agent, or Firm*—Laurence A. Greenberg; Werner H. Stemer; Ralph E. Locher

(57) ABSTRACT

The invention relates to a method for producing sugar or saccharated products from saccharated plant materials. Said method is characterized in that the production process is at least partially carried out in the presence of added fatty acids or the soaps thereof, aldehydes or alcohols.

22 Claims, No Drawings

METHOD FOR PRODUCING SUGAR AND SUGAR-CONTAINING PRODUCTS FROM SUGAR-CONTAINING PLANT RAW MATERIALS

BACKGROUND OF THE INVENTION

Field of the Invention

The invention relates to a method of producing sugar or sugar-containing products from sugar containing plant raw materials.

Sugar (sucrose) and sugar products are mainly recovered from the plant raw materials sugar beet and sugar cane by mechanically comminuting these plants and extracting, or pressing out, respectively, sugar-containing solutions from the plant parts.

Within certain temperature ranges, pH values and concentration limits, all sugar-containing media, in particular those immediately recovered from agricultural raw materials, are subject to a microbiological deterioration by bacteria, yeasts and molds. In a food-technological process, the danger of an infestation by microorganisms always is a substantial risk both in continuous operation and also during the storage of raw and intermediate products. Microorgansims are capable of degrading sugar contained in said raw materials to acids and gaseous, partially even explosive metabolic products and cause an immoderate high content of germs in the end product. During the process of recovering sugar from beets and from sugar cane, there is an additional risk of a microbial cleavage of the disaccharide Saccharide sucrose into the monosaccharides glucose and fructose, which, in addition to the immediate loss of sucrose, also involves further disadvantages, since by this, e.g. a more pronounced syrup discoloration, an increased demand of alkalizing agents and an increased accrual of molasses are caused.

At temperatures of up to 50° C., which are applied during the juice recovery with mechanical cell opening, the sugar-containing extraction solutions are subject to the deterioration by all the microorganisms mentioned, i.e. yeasts, molds and bacteria. In the juice recovery with thermal cell opening which occurs at temperatures of more than 50° C., however, only thermophilic bacteria are capable of proliferation. An example of such a thermal extraction method is the extraction of sugar beets generally carried out at present for the purpose of producing sugar.

It is common to fight thermophilic bacteria in extraction plants in that germ-inhibiting or germicidal auxiliaries are discontinuously or continuously added to the flow of juice or to the perishable intermediate products. For instance, in the sugar industry, formalin, dithiocarbamate, peracetic acid, ammonium bisulfite, quaternary ammonium bases etc. are common for this purpose.

More recently, in some sugar refineries also hop products (EP-0 681 029 A; Pollach et al., Zuckerindustrie 124 (8) (1999), 622-637; Pollach et al., Zuckerindustrie 121 (2) (1996), 919-926; Hein et al., Zuckerindustrie 122 (12) (1997), 940-949) and resin products (WO 01/88205 A1; Pollach et al., Zuckerindustrie 127 (2002) 921-930) have been used as a natural means for fighting microorganisms, if an addition of chemical agents is not desired or is legally prohibited. However, when employing these natural agents, unfortunately a selection of resistant bacterial strains or an adaptation of bacteria is more often observed than when using chemical agents, such as form alin, e.g. The latter non-specifically attacks proteins (Weinberg E. D., J. Soc. Cosmet. Chem. 13 (1962) 89-96) and exhibits less adaptation of bacteria, yet just because of this non-specific attack on proteins it has become a matter of dispute.

From the field of medicine it is known that in case an antibiotic has become ineffective, by changing to another agent a germ-inhibiting effect can be reached again, this, however, not being guaranteed. Bacterial strains which are resistant to a certain agent and thus are specialized will prevail when the former is applied, yet it is highly probable that they will not be resistant against all the alternative agents in the same manner. A broader selection of alternative germ-inhibiting agents will very probably be effective in any event.

In U.S. Pat. No. 5,434,182 A, the use of various fatty acids ($C_4$-$C_{22}$) and their esters has been described for fighting bacteria and viruses in animal organism, including humans. Yet, according to this U.S. patent, the use of these fatty acids is exclusively restricted to the medical-pharmaceutical fields. A use of the fatty acids and their esters described in the U.S. patent in the production of sugar is, however, not obvious to the person skilled in the art, since, as is generally known, the requirements made on antimicrobial substances in the medical field are highly different from those of the food industry, in particular the production of sugar.

SUMMARY OF THE INVENTION

Nevertheless, fatty acid esters are employed in a large number of production methods in food industry. The object is either to change the physical properties of the solutions, or to restrict the microbial deterioration.

Thus, in U.S. Pat. No. 4,427,454 A, the addition of fatty acid glycerol-esters for reducing the viscosity and the foam content during the production of sugar is disclosed. On the other hand, JP59063199 A relates to the removal of starch from various sugar solutions by means of fatty acid glycerol ester which consist of $C_8$-$C_{22}$ fatty acids. The use of fatty acid esters for these purposes by no means will allow the person skilled in the art to assume fatty acid compounds to have antimicrobial properties in this context.

In JP10070971 A and JP62163678 A, the use of fatty acid sucrose esters consisting of fatty acids with 8-22 carbon atoms, or of fatty acid polyglycerol esters is described. These esters are used in order to preserve clear liquid foodstuffs, such as e.g. juices or soups. The compositions of the solutions and suspensions to be treated within the context of sugar production is much more complex than in pure, clear liquids, primarily considering the high sugar concentration, the high temperatures and the presence of turbid matter and solid matter. For this reason, neither by the application JP10070971 A, nor by JP62163678 A it is rendered obvious to the person skilled in the art to employ fatty acid compounds as antimicrobial substances in the production of sugar or sugar-containing solutions from sugar-containing plant raw materials.

However, at the same time it has also been shown that many agents for which a possible germ-inhibiting activity has been described or suggested in some fields, did not exhibit this activity within the context of the industrial sugar production process. On the one hand, this could be due to the material to be treated within the scope of sugar production and to the process conditions required there, while, on the other hand, e.g. also the—sometimes highly variable—composition of the contaminating microorganisms could be a reason for the lack of success during the sugar production.

Therefore, the present invention has as its object to provide a method of the initially described type, by which the growth of undesired microbes within the scope of the industrial production process of sugar can be suppressed by means of natural agents, primarily also when microorganisms occur which are insensitive to hop and/or resin products.

According to the invention, this object is achieved by a method for producing sugar or sugar-containing products from sugar-containing plant raw materials, which is characterized in that the production at least partially is carried out in the presence of fatty acid compounds according to the invention, which comprise fatty acids or the soaps, aldehydes and alcohols thereof.

Surprisingly, by adding such fatty acid compounds in the course of the industrial sugar production process, an efficient and cost-effective option could be provided by which the growth of undesired microbes could effectively be prevented. Particularly thermophilic microorganisms which constitute especially tough problems during the sugar production process that are hard to fight can be inactivated by means of the inventive addition of fatty acid compounds according to the invention.

It is not necessarily required for these fatty acid compounds to be present during the entire production process. According to the invention, the use of the fatty acid compounds according to the invention may also occur in selected partial processes only. According to the invention, the partial or temporary presence of the admixed fatty acid compounds has proven successful particularly under those conditions under which thermophilic microorganisms would grow particularly well.

According to the invention, of course primarily sugar beet and sugar cane are considered as plant raw materials. In principle, however, the inventive method is applicable to all plant starting materials possible, such as, e.g., in the sugar production starting from sugar palm, dates, sugar millet, sugar maize, tree juices, such as, e.g., maple juice, etc.

Preferably, fatty soaps are used according to the invention, yet they may also be dosed dissolved in fatty acid solvents, in molten form or in solid form by pouring them into vat extraction systems. The fatty acid compounds according to the present invention may, however, also be fatty acid alcohols, fatty acid aldehydes. The fatty acid compounds may also be modified, e.g. by the incorporation of functional groups, such as —OH, —SH, —$NH_2$, —F, —Cl, —Br, —I and the like (with the exception of such derivatives that are toxic or not applicable in food technology); also aliphatic side chains and/or one or more (in particular two or three) (unsaturated) double bonds are possible as long as the physico-chemical properties of the (aliphatic) basic chain, in particular the solubility in anti-microbial concentrations, as well as the structure at the $C_1$-atom are retained.

When using aliphatic carboxylic acids or soaps as fatty acid compounds, (main) chain lengths of more than 6, preferably more than 8, in particular more than 10, and of fewer than 22, preferably fewer than 21, in particular fewer than 20, have proven effective in acceptable doses during tests in line with the conditions prevailing in the industrial sugar production, so that the following acids as well as their soaps are considered particularly preferred: heptanoic, caprylic, pelargonic, caprinic, undecanoic, lauric, tridecanoic, myristic, pentadecanoic, palmitic, heptadecanoic, stearic, nonadecanoic, arachidic, henicosanoic acid as well as the associated soaps, in particular the $C_{10}$, $C_{12}$, $C_{14}$, $C_{16}$ and $C_{18}$ fatty acid compounds (caprine, laurin, myristin, palmitin and stearin compounds (primarily the acids, soaps and alcohols)) which are available in industrially usable amounts at low costs or (like the alcohols) can easily be recovered therefrom. Such fatty acid products are well defined substances which substantially consist of one active substance only.

Particularly the myristic acid or myristin soap has been proven highly successful according to the invention, primarily as regards its antimicrobial activity. In some instances also myristic esters may exhibit an antimicrobial effect, wherein, however, only methyl myristate, yet not ethyl- and propyl myristate, with an inhibitory concentration of approximately 100 mg/ml can be considered as equivalent to the inventive compounds. Moreover, the myristin compounds also have other advantages: myristic acid melts at lower temperatures than the comparable natural resins (e.g. colophony) orhop, i.e. at 54° C., which in terms of safety technology is advantageous during its use and makes an application of vapor as heating medium unnecessary, respectively. The lower melting point of myristic acid as compared to resin and hop is also advantageous in terms of application technology, since the risk of scalding is reduced and one can do with the waste heat of the sugar industry (hot water). Yet, on the other hand, the melting point of 54° C. is not so low that gluing, e.g. by slight melting of free-flowing sacked material at common (or higher) ambient temperatures. Thus, myristic acid ($C_{14}$) is ideal also in terms of application technology. (Note: $C_{11}$, e.g., has a melting point of 30° C., $C_{10}$ has a melting point of 31° C. These products are neither liquid nor free-flowing and not as advantageous in terms of application technology as the $C_{14}$ compounds.) In general, tests have shown that as a rule the free fatty acids and their soaps according to the present invention exhibit a better anti-microbial efficacy than the aldehydes and esters thereof.

Moreover, myristic acid (in contrast, e.g., to hop) does not have a (bitter) inherent taste. Finally, myristic acid is highly precipitable by Ca, whereby a high elimination can be ensured in the juice purification. Also myristyl alcohol (1-tetradecanol) is effective at concentrations of 10 ppm or even less (in contrast to stearyl alcohol, with which—if at all in an industrial process—markedly higher concentrations have to be employed). Fatty acid compounds to be used according to the invention therefore preferably are already effective at 100 ppm, preferably at 50 ppm, more preferred at 10 ppm, in particular at 1 to 10 ppm, e.g. at 55 or 65° C.

Sorbic acid compounds or other shorter-chain ($C_6$ (caproic acid) or shorter) or longer-chain ($C_{22}$ (behenic acid) or longer) compounds have not proven as suitable for sugar industry—at least on an industrial scale. Neither are toxic compounds or quaternary ammonium bases, alkoxylated resins, and the like, industrially usable.

Many fatty acid compounds are physiologically harmless natural products. Since in the sugar production process mainly such harmless products shall be used, in particular lauric, myristic, palmitic and stearic acid(s) as well as their soaps are preferred also for this reason. Of course, also any combinations of fatty acid compounds according to the invention are usable.

Even though the possibility of a germ-inhibiting effect of fatty acids has been known for some fields or has been postulated in the past (sorbic acid, a di-unsaturated fatty acid with 6 C-atoms, is used as such and as potassium salt for the preservation of foodstuffs and categorized as harmless; furthermore, undecylenic acid is mentioned as an anti-microbial active substance (Wallhäuser, Praxis der Sterilisation—Desinfektion—Konservierung, 5$^{th}$ Ed., Thieme Stuttgart, 1995, p. 520)), and in higher free fatty acids, even an effect has been found on pure cultivation strains (e.g. LIH-LING et al., Applied and Environm. Microbiol., 58, 1992, pp. 624-629), yet, in practice these fatty acids have not proven to be successful as disinfectants for mixed cultures. Often concentrations of up to 1 g of fatty acid per liter are still termed as effective (Kabara et al., Lipids, 12 (1977) 753-759), which would be utterly insufficient for the production of sugar (at a high dose, even sugar and salt are bacteria-inhibiting, yet, sugar, or salt, respectively, evidently are not suitable to obtain the inventive effects within the scope of the sugar production process).

In the course of time it has also been found that the postulated germ-inhibiting effect of fatty acid compounds could not be substantiated and at present it is no longer considered to be a fact or even to be industrially utilizable: While the 3rd edition of Ullmanns Enzyklopadie der technischen Chemie (1954, Vol. 5, Desinfektion und Sterilisation, p. 753) still reports on fatty acids as disinfectants (in the '40s one was still relatively optimistic with regard to the disinfecting effect of fatty acids in medicine), in the 4th edition (1975, Vol. 10, pp. 47-48) this chapter has been greatly shortened in the chapter "Desinfektionsmittel" ("Das Wirkungsmaximum von Fettsäuren soll bei $C_{11}$ bis $C_{12}$ liegen . . . " ["The maximum effect of fatty acids is said to be at $C_{11}$ to $C_{12}$ . . . "], and "Über die Bakterizidie der Seifen liegen stark widersprechende Befunde vor . . . " ["Regarding the bactericidal effect of soaps, there exist highly contradictory findings . . . "]), and in the 5th edition (1987, Vol A8), in chapter "Desinfectants" nothing is reported on this any more. From this it appears that at normal temperatures there exist too many fatty acid-insensitive microorganism strains and that today, fatty acids are no longer counted among the disinfectants.

If at 35-45° C., i.e. at those temperatures, at which it is usually worked in microbiology, a culture medium is inoculated with non-sterile crude juice from a sugar beet extraction, in most cases it is difficult to stop, by the addition of fatty acids, an acid formation recognizable by a drop in the pH (particularly in mixed cultures in which insensitive microorganism can prevail). On the other hand, the acid formation at 55° C. and 65° C. is blocked by fatty acids, depending on the chain lengths, at concentrations of from 4 to 40 mg/l over a period of time of from 1 to 10 hours. While a maximum of $C_{11}$-$C_{12}$ is indicated for the effects observed at normal temperature (Ullmann 1975), for thermophilic microorganisms at the higher temperature the effective maximum lies at $C_{14}$ (myristic acid)

It has been known that in organic preserving acids, such as sorbic acid, the undissociated form is effective (Wallhauser, Praxis der Sterilisation—Desinfektion—Konservierung, 5th Ed., Thieme Stuttgart, 1995, p. 507). The same holds for fatty acids with higher chain lengths (Ullmann 1954). In acidic aqueous media, however, fatty acids of higher chain lengths cannot unfold an activity if the solubility lies under the minimum inhibitory concentration of the microorganisms. By using them against thermophilic microorganisms at higher temperature, less readily soluble fatty acids of longer chain lengths ($C_{14}$) can be highly effective in acidic media.

According to the invention, it has been shown that the claimed fatty acid compounds should be used in an amount of from 0.1 to 100 mg/l, preferably from 5 to 40 mg/l, in particular from 10 to 25 mg/l. The fatty acid compounds according to the invention preferably have a minimum inhibitory concentration of below 50 mg/l, more preferred, of below 40 mg/l, particularly preferred of below 30 mg/l, in particular of below 20 mg/l. The at least partial, or at least temporary, respectively, presence of inventive fatty acid compounds in this amount in the liquid phase during the sugar production process has been found to be suitable, or in any event, to be sufficient for the desired germ-inhibiting effect. It is, however, clear that depending on the realization of the sugar production process (continuous/discontinuous), the concentration of fatty acid compounds may vary, particularly if the products are intermittently added to the production process, e.g. into the extraction solution. Particularly preferred concentration levels of the fatty acid compounds to be employed according to the invention during the production process are between 5 to 40 mg/l, in particular 10 to 25 mg/l.

Preferably, the fatty acids are added as fatty soaps. In doing so, alkaline or alkaline earth (except for calcium), preferably potassium salt solutions have proven to be successful, in particular at concentrations of from 0.5 to 30%. The fatty acids may also be added as alcoholic solutions or suspensions, in particular as an ethanol solution of 1 to 100%, preferably of 1 to 95%, in particular of 10 to 80%. It has been shown that the inventive use of fatty acid compounds is particularly suitable for a combination with further anti-microbial agents in the course of the production process. Within the scope of such a combination, preferably further food-compatible, anti-microbial agents are employed.

Here, the inventive combination with hop, hop derivatives and food-compatible resins is particularly preferred. Sugar production processes in which hop or hop derivatives are used are described e.g. in EP 0 681 029 B1. Methods in which food-compatible resins alone and in combination with hop and with hop derivatives are used are described in WO 01/88205 A1. According to the invention, the combination of the further anti-microbial agents with inventive fatty acid compounds may be carried out both partially as well as serially. Thus, e.g., the sugar production process may be carried out temporarily in the presence of admixed fatty acid compounds, temporarily with the use of resins, and temporarily in the presence of hop products, e.g. hop-β-acids, this being so both consecutively as well as in combination.

The inventive addition of fatty acids may as such occur at any point of the sugar production, yet preferably the inventive fatty acid compounds are present at least in the thermal extraction of sugar-containing plant parts, in particular sugar beet or sugar cane. There, e.g. myristin soap may be added to the extracting plant parts after mechanically comminuting the sugar-containing plant raw materials.

Preferred temperature conditions for the inventive application of the fatty acid compounds are 50 to 80° C., in particular 55 to 70° C.

According to a preferred embodiment of the method according to the invention, the claimed fatty acid compounds are used during the recovery of the crude juice. An illustration of the common production process for sugar is contained, e.g., in Ullmann's Encyklopädie der Technischen Chemie, 4th edition, Vol. 24, pp. 703-748, wherein the inventive addition of fatty acid compounds may be carried out in all the (partial) steps described there.

Preferably, according to the invention the claimed fatty acid compounds are added to the extraction solution by means of which the sugar is extracted from the sugar-containing plants in raw materials.

According to a particularly preferred embodiment, membrane treatment methods or ion exchange methods during the sugar production process are carried out in the presence of the inventive fatty acid compounds.

Preferably, the claimed fatty acid compounds are used at a sugar concentration of from 0.1 to 80%, in particular at higher temperatures, such as at temperatures of from 50 to 80° C.

The risk of bitter flavors being introduced into the sugar products which had existed with hop products does not exist in the case of fatty acid compounds because the preferably used fatty acid compounds do not have a bitter taste. Fatty acid compounds without or with negligible inherent taste therefore are advantageous.

The treatment with an inventive fatty acid compound is particularly advantageously carried out alternatingly with the treatment with a microorganism-inhibiting agent based on hop or pine resin so as to fight an adaptation of the microorganisms to the hop or pine resin preparation, or a selection of hop- or pine resin-resistant microorganisms, respectively.

If no selection or adaptation is observed in a process, a combined agent can be used, e.g. of fatty acid compounds according to the invention and pine resins and/or hop products, in order to obtain a particularly high efficacy of a single combination agent.

If a sugar-containing substrate, e.g. a sugar-containing liquid culture medium, as it is common in microbiology, is either non-sterilized or incubated after inoculation with a bacterial strain, an acid formation will occur which is the easiest to recognize by a drop in the pH. The same phenomenon will occur when incubating normal sugar-containing plant juices, e.g. beet juice. In an industrial process, e.g. in the recovery of sugar juice from sugar beets, a drop in the pH by degradation of sugar means a loss of sugar and a need for an alkalizing agent. Moreover, a drop in the pH with an increase in the germ content in the substrate often is associated with an unpleasant gas and nitrite formation. This arrangement also forms an efficient system for determining the germ-inhibiting activity of substances within the scope of the sugar production process.

If during such an acid formation caused by thermophilic microorganisms at higher temperatures, for instance a solution of fatty acid compounds according to the invention is added, the acid formation and the drop in the pH associated therewith will stop starting from a certain concentration of 10 ppm. Thus, the disadvantages associated with the acid formation can be avoided by the addition of myristic acid, e.g., to a sugar-containing substrate. Therefore, preferably increased temperatures are used, since the fatty acid compounds are less readily soluble in cold aqueous systems than in warm systems. Therefore, even because of their better solubility, they can be particularly well used at higher temperatures against thermophilic microorganisms. Moreover, at high temperatures the microorganism flora is restricted to a few types of bacteria.

Relative to yeasts, fatty acid compounds according to the invention, myristic acid, e.g., surprisingly exhibit a markedly lower efficacy than relative to thermophilic bacteria. Moreover, they have poor solubility under the pH and temperature conditions of yeast growing so that the properties known of hop and pine resin products which mainly cause an inhibition of the bacteria, also occur in fatty acid compounds. When using fatty acid compounds according to the invention within the scope of beet extraction, i.e. prior to purifying the juice with lime and carbonic acid, these fatty acid compounds are separated to a high degree. Fatty acid form insoluble soaps with Ca ions which are discharged from the process flow together with calcium carbonate. This constitutes an advantage of fatty acids as bacteria-inhibiting agent for the extraction of sugar beets, since the amounts remaining in the molasses and the traces adhering to the finished sugar will be decisively reduced by the ability to be precipitated by Ca. Those residual amounts of fatty acids which are not precipitated as Ca salts during the juice purification and get into the molasses which is destined to be used by yeasts, therefore can be considered as harmless as compared to some chemical means, such as quaternary ammonium bases.

According to a further aspect, the present invention also relates to an extraction liquid for extraction of sugar-containing plant raw materials, which in addition to the common components of this extraction liquid contains added (i.e. not naturally present (in this amount)) fatty acid compounds. Besides the extracted sugar (sucrose), such extraction liquids contain traces of glucose and fructose, as well as components characteristic of the respective plant raw material, e.g. betaine (in sugar beets) or aconitic acid (in sugar cane). Further ingredients may be amino acids, such as alanine, aspartic acid, glutamic acid, isoleucine, leucine, threonine or valine (in a range of 10-200 mg/l crude juice), oxalate, citrate, lactate or maleate (10-5000 mg/l crude juice), or shikimic acid, respectively, or flavonoids or phenolic components, such as caffeinic acid, 3,4-dihydroxybenzoic acid, chlorogenic acid, apigenin, swertisin, luteolins or tricin. (Schneider, "Technologie des Zuckers", Verlag Schaper, Hannover (1968), 247-253; van der Poel et al., "Sugar Technology", Verlag Dr. Bartens, Berlin (1998), 152-157; van der Poel et al., "Zucker-technologie", Verlag Dr. Bartens, Berlin (2000), 163-168).

According to a preferred embodiment, the extraction liquid according to the invention additionally also contains admixed hop, hop derivatives and/or food-compatible resins.

According to a further aspect, the present invention also relates to sugar or sugar-containing products from plant raw materials obtainable by the method according to the invention and accordingly containing a (residual) content of admixed fatty acid compounds. This content can easily be detected by analytical methods known per se, such as gas chromatography etc. Sugars or sugar containing products preferred according to the invention exhibit a content of fatty acid compounds, starting from the detection limit up to 1 ppm. Yet, according to the invention, preferred products are also all sugars and by-products of sugar which are incurred in the industrial production of sugar, such as, e.g., beet chip animal feed, carbonated lime, thick juice and molasses. Beet chip animal feed which, e.g., is provided as a pressed product, is a particularly favorable environment for the growth of undesired microorganism. Such an infestation may, of course, decisively deteriorate the feed quality of these products. The presence of admixed fatty acid compounds not only reduces such product damage, but also the formation of undesired bad smells.

According to a further aspect, the present invention also relates to the use of fatty acid compounds according to the invention in the production of sugar. Here their use is particularly preferred for inhibiting thermophilic microorganisms, in particular for inhibiting *Bacillus, Thermus* and *Clostridia.*

The invention will now be explained in more detail by way of the following examples to which, of course, it is not limited.

EXAMPLE 1

A liquid culture medium, as commonly used in microbiology and consisting of 10 g of Bacto-peptone, 5 g of meat extract, 5 g of yeast extract, 1 g of glucose, 1 g of $K_2HPO_4$, 0.1 g of $MgSO_4*7H_2O$ and 0.01 g of $FeSO_4*7H_2O$ per liter of distilled water, is sterilized in conventional manner for 20 min at 120° C. and inoculated, in a vessel kept at a temperature of 65° C., with 20 ml of crude juice from a large-scale sugar beet extraction, wherein the pH is registered on a recorder. Upon the growth of thermophilic bacteria, the pH drops progressively. This indicates a microorganism-caused acid formation.

In the present example, starting from an incubation of about 4 h, such microorganisms cause an increasingly pronounced pH drop (ΔpH/h). By the addition of 1 ml of a 1% alcoholic solution of myristic acid per liter culture liquid, the pH drop is suddenly and lastingly stopped after 5 hours. There results an at least 14 h effectiveness at a concentration of 10 mg of myristic acid per liter culture liquid. The effect is due to the fatty acid, since only amounts of from 40-60 ml alcohol per liter culture liquid impair such a culture.

| Time (h) | 0 | 1 | 2 | 3 | 4 | 4.25 | 4.50 | 4.75 | 5 | 5.10 | 5.50 | 6 | 7 | 10 | 13 | 16 | 19 |
|---|---|---|---|---|---|---|---|---|---|---|---|---|---|---|---|---|---|
| pH | 6.95 | 6.94 | 6.94 | 6.93 | 6.90 | 6.86 | 6.80 | 6.72 | 6.55 | 6.47 | 6.47 | 6.47 | 6.48 | 6.50 | 6.53 | 6.55 | 6.53 |
| ΔpH/h | | 0.01 | 0.00 | 0.01 | 0.03 | 0.16 | 0.24 | 0.32 | 0.68 | 0.80 | 0.00 | 0.00 | −0.01 | −0.01 | −0.01 | −0.01 | 0.01 |

Additon of 10 mg/l myristic acid at pH 6.47.

EXAMPLE 2

In a mixed culture according to Example 1, the growth of thermophilic bacterial shows in an ever increasing pH drop (ΔpH/h). By adding 1 ml of a 1% alcoholic solution of palmitic acid per liter culture liquid, which corresponds to 10 mg/l, after 5 hours the pH drop is immediately completely stopped, yet in contrast to Example 1, already after 1.5-2 h, there occurs a renewed pH drop in the culture. A renewed addition of palmitic acid up to a total concentration of 50 mg/l can no longer stop this pH drop, but merely retard it from 0.13 to 0.07 pH units per hour. The Example shows a basic effect of palmitic acid ($C_{16}$) which, however, lasts only for a very short period. Quite similar is the behavior of stearic acid ($C_{18}$) and oleic acid ($C_{18:2}$), whereas behenic acid ($C_{22}$) does not exhibit any effect in such an example.

| Time (h) | 0 | 1 | 2 | 3 | 3.50 | 3.75 | 4.00 | 4.25 | 4.50 | 4.75 | 5.00 | 5.10 | 6.00 | 6.50 | 7 | 8 | 9 |
|---|---|---|---|---|---|---|---|---|---|---|---|---|---|---|---|---|---|
| pH | 7.06 | 7.05 | 7.04 | 7.04 | 7.03 | 7.02 | 6.98 | 6.93 | 6.86 | 6.77 | 6.61 | 6.52 | 6.53 | 6.53 | 6.49 | 6.36 | 6.29 |
| ΔpH/h | | 0.01 | 0.01 | 0.00 | 0.02 | 0.04 | 0.16 | 0.20 | 0.28 | 0.36 | 0.64 | 0.90 | −0.01 | 0.00 | 0.08 | 0.13 | 0.07 |

Addition of 10 mg/l palmitic acid at pH 6.52 and 4×10 mg/l between pH 6.49 and 6.36.

EXAMPLE 3

In a mixed culture according to Example 1, a pH drop occurs due to thermophilic bacterial. Two additions of 1 ml of a 1% alcoholic solution of lauric acid ($C_{12}$), corresponding to a concentration of 20 mg/l, does not have any effect. Only a third addition of 1 ml of solution, corresponding to a total concentration of 30 mg/l, stops the pH drop. In case of undecanoic acid ($C_{11}$), in such an example an effect is only reached at 40 mg/l. With sorbic acid ($C_{6:2}$), a well-known preservative, surprisingly no effect is achieved even at 150 mg/l. This shows that the effect of fatty acids at higher temperatures cannot be derived from data in the literature concerning mesophilic microorganisms.

| Time (h) | 0 | 1 | 2 | 3 | 3.25 | 3.50 | 3.75 | 4.00 | 4.25 | 4.50 | 4.75 | 5 | 6 | 7 | 8 | 9 | 10 |
|---|---|---|---|---|---|---|---|---|---|---|---|---|---|---|---|---|---|
| pH | 7.08 | 7.08 | 7.07 | 7.06 | 7.03 | 6.99 | 6.94 | 6.87 | 6.74 | 6.49 | 6.49 | 6.49 | 6.50 | 6.51 | 6.52 | 6.52 | 6.53 |
| ΔpH/h | | 0.00 | 0.01 | 0.01 | 0.12 | 0.16 | 0.20 | 0.28 | 0.52 | 1.00 | 0.00 | 0.00 | −0.01 | −0.01 | −0.01 | 0.00 | −0.01 |

Addition of 3×10 mg/l lauric acid between pH 6.74 and 6.49.

EXAMPLE 4

A liquid culture medium, as in Example 1, is inoculated with a pure culture strain DSMZ 457 of the Deutsche Sammlung für Mikroorganismen und Zellkulturen GmbH. A pH drop starting after 1 hour can be stopped by two additions of 0.2 ml of a 1% alcoholic solution of myristic acid ($C_{14}$), corresponding to a concentration of merely 4 mg/l. After 4 hours, a renewed pH drop starts which can be stopped for further 7 hours by a further addition of 2 mg/l, i.e. in sum 6 mg/l. This Example shows that similar effects can be achieved also on pure cultures, even with very low concentrations.

| Time (h) | 0 | 1 | 2 | 3 | 4 | 4.50 | 5 | 6 | 7 | 8 | 9 | 10.2 | 11 | 12 | 13 | 14 | 15 |
|---|---|---|---|---|---|---|---|---|---|---|---|---|---|---|---|---|---|
| pH | 7.08 | 7.07 | 7.04 | 6.99 | 6.81 | 6.51 | 6.50 | 6.51 | 6.51 | 6.51 | 6.48 | 6.39 | 6.39 | 6.39 | 6.39 | 6.39 | 6.39 |
| ΔpH/h | | 0.01 | 0.03 | 0.05 | 0.18 | 0.60 | 0.02 | −0.01 | 0.00 | 0.00 | 0.03 | 0.08 | 0.00 | 0.00 | 0.00 | 0.00 | 0.00 |

Addition of 2×2 mg/l myristic acid between pH 6.81 and 6.51, and further 2 mg/l at pH 6.39.

EXAMPLE 5

A mixed culture according to Example 1 is prepared, yet incubated at 35° C. A pH drop starting after 5 hours cannot be stopped by 11 successive additions of 1 ml of a 1% alcoholic solution of myristic acid per liter culture, corresponding to 110 mg/l, and a further addition of 4 ml, i.e. in sum 150 mg/l. This Example shows the characteristic difference in behavior between mesophilic and thermophilic mixed cultures.

| Time (h) | 0 | 1 | 2 | 3 | 4 | 4.50 | 4.75 | 5.00 | 5.25 | 5.50 | 5.75 | 6.00 | 6.25 | 6.50 | 6.75 | 7.00 | 7.25 |
|---|---|---|---|---|---|---|---|---|---|---|---|---|---|---|---|---|---|
| pH | 7.06 | 7.05 | 7.04 | 7.03 | 7.02 | 7.01 | 6.99 | 6.95 | 6.90 | 6.81 | 6.70 | 6.55 | 6.41 | 6.30 | 6.19 | 6.06 | 5.94 |
| ΔpH/h | | 0.01 | 0.01 | 0.01 | 0.01 | 0.02 | 0.08 | 0.16 | 0.20 | 0.36 | 0.44 | 0.60 | 0.56 | 0.44 | 0.44 | 0.52 | 0.48 |

Addition of 11×10 and 1×40 mg/l myristic acid between pH 6.55 and 6.30.

EXAMPLE 6

A mixed culture according to Example 1 is prepared. A pH drop starting after 4 hours can suddenly and lastingly be stopped by the addition of 1 ml of a 1% aqueous solution of myristic acid as potassium salt per liter culture liquid. There results an at least 12 hour effectiveness at a concentration of 10 mg of myristic acid (as potassium salt) per liter culture liquid.

| Time (h) | 0 | 1 | 2 | 3 | 4 | 4.25 | 4.50 | 4.75 | 5 | 6 | 7 | 8 | 9 | 11 | 13 | 15 | 17 |
|---|---|---|---|---|---|---|---|---|---|---|---|---|---|---|---|---|---|
| pH | 6.92 | 6.90 | 6.89 | 6.89 | 6.85 | 6.82 | 6.75 | 6.67 | 6.46 | 6.46 | 6.46 | 6.47 | 6.46 | 6.46 | 6.46 | 6.45 | 6.45 |
| ΔpH/h | | 0.02 | 0.01 | 0.00 | 0.04 | 0.12 | 0.28 | 0.32 | 0.84 | 0.00 | 0.00 | −0.01 | 0.01 | 0.00 | 0.00 | 0.00 | 0.00 |

Addition of 10 mg/l myristic acid as potassium salt at pH 6.46.

EXAMPLE 7

A beet extraction plant for continuously processing 12,000 t of beets per day, consisting of an extraction tower and chip mashes, is operated without the addition of known agents for reducing the bacterial activity, such as formalin, dithiocarbamates, hop and resin products. A lactic acid content of 630-790 mg/l occurs in the crude juice. By three doses of a soap solution with 20% myristic acid in an amount of 200 l each at 9, 13 and 17 hours, which corresponds to a dosage of 10 g/t of beets, the lactic acid content can be lowered to between 450 and 550 mg/l in the course of a day. An automatic metering with doses equally distributed over 24 h would be desirable.

EXAMPLE 8

Determining the MIC Values: Effect of Fatty Acids And their Alcohols, Respectively, as Compared to Fatty Acid Esters As the minimum inhibitory concentration (MIC) of an antimicrobial substance that minimal concentration is to be considered at which this substance shows an effect, i.e., the lower this value, the less antimicrobial substance needs to be added in order to stop the growth of microorganisms. To illustrate the antimicrobial activity within the scope of sugar production, examples are carried out with myristin compounds by way of example.

A liquid culture medium as commonly used in microbiology and consisting of 10 g of Bacto-peptone, 5 g of meat extract, 5 g of yeast extract, 1 g of glucose, 1 g of $K_2HPO_4$, 0.1 g of $MgSO_4*7H_2O$ and 0.01 g of $FeSO_4*7H_2O$ per liter of distilled water, is sterilized in conventional manner for 20 min at 120° C. and inoculated, in a vessel kept at a temperature of 65° C., with 20 ml of crude juice from a large-scale sugar beet extraction, wherein the pH is registered on a recorder. Upon the growth of thermophilic bacteria, the pH drops progressively. This indicates a microorganism-caused acid formation.

The determination of the MIC values was carried out by stepwise addition of fatty acid compounds in 10 mg/l steps until the stabilization of the pH, which suggests the end of the microorganism growth, or until a maximum concentration of 150 mg/l has been reached, respectively, beyond which an industrial use would be completely impossible for economic reasons. The results are shown in the following table:

| Product (dissolved in ethanol) | Min. Inhibitory Conc. (MIC) [mg/l] |
|---|---|
| Propyl-Myristate | no effect at maximum concentration (>150) |
| Ethyl-Myristate | no effect at maximum concentration (>150) |
| Myristyl Alcohol | 10 |
| Myristic Acid | 10 |

The tests show that the free fatty acid (myristic acid here) and its alcohol have an MIC value of 10 mg/l each, whereas the corresponding esters are ineffective in the tested concentration range.

EXAMPLE 9

Determining MIC Values: Myristic and Lauric Acids

Comparable to Example 8, the determination of the MIC values was carried out by the step-wise addition of fatty acid compounds in steps of 2 mg/l until the stabilization of the pH, which suggests the end of the microorganism growth. The fatty acid compounds used in this Example are myristic acid and lauric acid, and their potassium salts, respectively. In this case, the acids were used both individually and in a 1:1 mixture, the salts were exclusively used in a 1:1 mixture. The results are illustrated in the following table:

| Product (dissolved in ethanol) | Min. Inhibitory Conc. (MIC) [mg/l] |
|---|---|
| Myristic acid | 6 |
| Myristic and lauric acids (1:1) | 8 |
| Potassium myristate and laurate (1:1) | 8 |
| Lauric acid | 18 |

The tests show that myristic acid can successfully be used at a substantially lower concentration (6 mg/ml) than lauric acid (18 mg/ml). Surprisingly, with a 1:1 mixture of both acids (8 mg/ml), a similar MIC could be found as when exclusively adding myristic acid. Similarly efficient was a 1:1 mixture of the two potassium salts (8 mg/ml).

I claim:

1. A method of producing sugar or a sugar-containing product from a sugar-containing plant raw material, the method which comprises:

selecting a fatty acid compound, which has a chain length of 8-21 carbon atoms, from the group consisting of fatty acids, soaps of fatty acids, fatty aldehydes, and fatty alcohols;

producing sugar or a sugar-containing product from at least one sugar-containing plant raw material; and carrying out at least one process step, which is used for performing the step of producing sugar or a sugar-containing product, with an amount of 0.1 to 100 mg/l of the fatty acid compound.

2. The method of claim 1, wherein the fatty acid compound has a chain length of 10-18 carbon atoms.

3. The method of claim 1, wherein the fatty acid compound is derived from heptanoic, caprylic, pelargonic, caprinic, undecanoic, lauric, tridecanoic, myristic, pentadecanoic, palmitic, heptadecanoic, stearic, nonadecanoic, arachidic, or henicosanoic acid.

4. The method of claim 1, wherein alcohols of the $C_{10}$, $C_{12}$, $C_{14}$, $C_{16}$ and $C_{18}$ fatty acid compounds are used.

5. The method of claim 1, wherein the fatty acid compound is used in an amount of 5 to 40 mg/l.

6. The method of claim 1, wherein the fatty acid compound is used in an amount of 10 to 25 mg/l.

7. The method of claim 1, wherein the fatty acid compound is an alkaline or alkaline earth solution or suspension.

8. The method of claim 7, wherein the fatty acid compound is a potassium soap solution.

9. The method of claim 8, wherein the fatty acid compound is a 0.5 to 35% potassium soap solution.

10. The method of claim 1, wherein the fatty acid compound is used in combination with natural, food-compatible resins, hops and hop-β acids including hop products or combinations thereof.

11. The method of claim 1, wherein the fatty acid compound is used in the thermal extraction of sugar-containing plant part.

12. The method of claim 1, wherein the fatty acid compound is added to the extraction solution with which the product comprising sugar is extracted from the sugar-containing plant raw materials.

13. The method of claim 1, wherein the fatty acid compound is added at least during membrane treatment methods and/or during ion exchange methods.

14. The method of claim 1, wherein the fatty acid compound is used at a sugar concentration of from 0.1 to 80%.

15. The method of claim 14, wherein the fatty acid compound is used at a sugar concentration of 60 to 70%.

16. The method of claim 1, wherein the fatty acid compound is used at a temperature of from 50 to 80° C.

17. A method of claim 1, wherein the fatty acid compound is used during the recovery of the sugar from the thick juice.

18. The method of claim 1, wherein the step of carrying out at least one process step is performed by adding the fatty acid compound to the sugar, to the sugar-containing product, to the plant raw material, or to a product obtained intermediate to obtaining the sugar or the sugar-containing product.

19. The method of claim 1, wherein the fatty acid compound is used in the thermal extraction of sugar beets or sugar cane.

20. The sugar-containing product obtained by the method according to claim 1.

21. The sugar-containing product of claim 20 selected from the group consisting of beet chip animal feed, carbonated lime, thick juice and molasses.

22. Sugar obtained by the method according to claim 1.

* * * * *